United States Patent [19]

Ghandehari

[11] 4,439,232

[45] Mar. 27, 1984

[54] SAMARIUM METAL PRODUCTION

[75] Inventor: Mohammad H. Ghandehari, Brea, Calif.

[73] Assignee: Union Oil Company of California, Los Angeles, Calif.

[21] Appl. No.: 352,891

[22] Filed: Feb. 26, 1982

[51] Int. Cl.[3] ..... C22B 4/00

[52] U.S. Cl. ..... 75/10 R; 75/12; 75/84

[58] Field of Search ..... 75/10 R, 84, 12

[56] References Cited

U.S. PATENT DOCUMENTS 3,104,970 9/1963 Downing ..... 75/84

OTHER PUBLICATIONS

A. H. Daane, D. H. Dennison, F. H. Spedding, *Jounral of the American Chemical Society*, vol. 75, pp. 2272–2273 (1953).

*Encyclopedia Brittanica, 15th Ed.*, vol. 15, pp. 523–525 (1980).

*Rare Metals Handbook, 2nd Ed.*, C. A. Hampel, Ed., p. 409, Reinhold Publishing Corp., London (1961).

*Primary Examiner*—Peter D. Rosenberg

*Attorney, Agent, or Firm*—Dean Sandford; Gregory F. Wirzbicki; Robert A. Franks

[57] ABSTRACT

In a method for the production of samarium metal byreducing samarium oxide in a container with rare earth metal, vaporizing reduced samarium, and condensing a metal product, the container for the samarium oxide and rare earth metal is lined on its inner surface with a disposable resistant metal foil having a thickness from about 0.001 inches to about 0.02 inches.

13 Claims, No Drawings

SAMARIUM METAL PRODUCTION

BACKGROUND OF THE INVENTION

1. Field of the Invention

The invention relates to a relatively non-reactive container for metal production, and more particularly to a container for samarium production which has a replaceable inner liner of resistant metal.

2. Description of the Art

Although rare earth metals, defined for purposes herein as elements having the atomic numbers 39 and 57 through 71 (namely, yttrium and the lanthanide elements), have been known and studied for many years, commercial uses for these materials have generally been slow to arise. Samarium in particular, due possibly to its relative scarcity when compared to some other rare earths, has not found a wide range of industrial applications. Fairly recently, however, the development of samarium-containing high energy permanent magnet materials, such as the intermetallic samarium-cobalt compositions, has substantially increased the demand for samarium metal of high purity.

Rare earth metals, including samarium, have been prepared for many years by fused salt electrolysis techniques, in which a molten flux containing rare earth compounds (e.g., rare earth halides) is electrolyzed using appropriate inert electrodes. Disadvantages of the technique include the product contamination resulting from corrosion and degradation of electrodes and cell containers, and the difficulty of separating the product metal from molten flux. In addition, the process is not well adapted to high production rates for certain metals, including samarium.

An even older preparative method is that involving metallothermic reduction of rare earth halides, using an active metal. The method has been developed to the point that small quantites of very high purity rare earth metals can be prepared, if some fairly elaborate precautions are taken. Various methods utilize lithium, sodium, potassium and calcium as reducing agent, but results are generally unsatisfactory for those rare earth metals which have the lowest boiling points, including samarium, europium, ytterbium and thulium.

A. H. Daane, D. H. Dennison and F. H. Spedding, in their paper "The Preparation of Samarium and Ytterbium Metals", *Journal of the American Chemical Society*, Vol. 75, pages 2272–2273 (1953), report a method for volatile rare earth metal preparation which involves heating a mixture of rare earth oxide and lanthanum metal in a tantalum crucible, and condensing the vapors of rare earth metal onto a perforated tantalum crucible lid. This method was conducted under a vacuum and at a temperature of 1450° C.

The noted method of Daane et al. can be advantageously utilized for the commercial production of samarium, since reasonably large quantities of product can be obtained if the crucible size is appropriately increased, and the requirements for equipment and other facilities are not stringent. Also, metal of satisfactory purity for most uses, e.g., the preparation of magnet alloys, is obtainable without elaborate precautions, due, at least in part, to the limited number of reactants and the limited number of materials which are allowed to contact the metal product.

Typically, a crucible for such preparation of samarium is fabricated from pure tantalum metal having sufficient thickness to impart the desired mechanical stability to the finished crucible. Although tantalum is one of the more resistant materials against attack by molten rare earth metals, some adhesion to the interior of the crucible is always observed at completion of a samarium preparation. It is not feasible to discard a crucible prior to its perforation or other mechanical breakdown, due to the very high cost of fabricated tantalum, so each crucible must be manually cleaned by chipping or grinding to remove the adhering material. This operation not only utilizes considerable expensive labor, but also tends to weaken the crucible, further shortening its useful life.

A need clearly exists for a means to extend the lifetime of tantalum crucibles for samarium production and to reduce or eliminate the necessity for time-consuming cleaning procedures on used crucibles.

Accordingly, it is an object of the present invention to prevent significant attack on a tantalum crucible which is used for samarium metal production. It is a further object of the invention to provide a liner for a tantalum crucible which will protect the crucible from attack and which can be discarded after use.

Another object is to improve the economics of samarium metal production by eliminating or greatly reducing cleaning procedures on used tantalum crucibles.

A still further object is to permit the use of crucibles which are less resistant than tantalum toward attack by molten rare earth metals.

These and other objects will appear more clearly from consideration of the following disclosure.

SUMMARY OF THE INVENTION

In the production of samarium metal by reducing samarium oxide with rare earth metal in a container, vaporizing reduced samarium, and condensing a metal product, the container is protected from attack by reactants and products by an inner liner of resistant metal, having a thickness from about 0.001 inches to about 0.02 inches.

Following a samarium preparation, the liner can be discarded and the container can be reused immediately, without any significant cleaning procedure.

DESCRIPTION OF THE INVENTION

Samarium metal is produced by the metallothermic reduction of its oxide using rare earth metal. The reduction generally is conducted under a partial vacuum, e.g. a pressure of about 10 to about 50 microns of mercury, and in an induction furnace yielding a temperature from about 1100° C. to about 1450° C. Under these conditions, reaction takes place, forming samarium metal and rare earth oxides. The temperature is higher than the melting point of samarium and, due to the high vapor pressure of the metal, separation of the samarium is accomplished by condensing its vapors using, for example, a perforated plate or inverted cone, usually of tantalum or other resistant material, placed above the container holding the reactants.

Rare earth metals which can be used to reduce samarium are the more reactive, lower atomic number rare earth such as lanthanum and cerium. A particularly useful material is the relatively inexpensive alloy mixture known as misch metal, normally having a weight percentage composition in the following ranges: cerium (45–50), lanthanum (22–25), neodymium (10–20), praseodymium (2–8), samarium (1–2), and small amounts of other rare earth elements. Misch metal is typically 94 to 99 percent by weight rare earth metals. For use in reducing samarium, it is desirable to obtain misch metal having a low iron content, since iron has a detrimental effect upon many materials used as containers and other components in the furnaces for samarium production. Mixtures other than misch metal are also useful in the practice of this invention.

Under the conditions of the above-described procedure, rare earth metals react with most of the known refractory materials, such as metals, oxides, carbides and nitrides. Only the metals tantalum, tungsten, niobium, and alloys in which one of them predominates have been found to be economically suitable as reusable containers. However, even these metals react to some extent with rare earth metals, necessitating a tedious, labor-intensive manual cleaning after each use, to remove adhering material from the containers. In addition, none of these metals is truly desirable for container construction due to their relative scarcity and resulting high cost, and to the high cost of fabricating articles from them, since special tools and techniques are required.

Notwithstanding the foregoing, tantalum containers have found use in the commercial production of pure samarium. A typical container can only be used for a total of approximately 20 to 30 production runs, resulting in a contribution of an estimated twenty percent to the total direct cost of producing a pound of samarium, for containers holding about 100 pounds of samarium oxide.

The technical literature contains reports indicating that molybdenum is suitable for use in contact with molten rare earth metals, such as H. E. Kremers, "Rare Earth Metals", in *Rare Metals Handbook, Second Edition,* C. A. Hampel, Ed., Reinhold Publishing Corp., London, 1961, at page 409. This reference states that molybdenum is usable up to 1400° C. in vacuum, but clearly points out that the material is wetted by rare earth metals. Due to this wetting, molybdenum containers would require cleaning operations similar to those presently utilized for tantalum. In addition, the usefulness of molybdenum is limited by the above-noted maximum temperature, since many samarium preparations approach or exceed 1400° C.

A far more serious matter, which prohibits the use of molybdenum as a reusable container for samarium metal production, is the well-known adverse effect of high temperatures on the physical properties of fabricated molybdenum articles. Depending upon the working history of a fabricated article, recrystallization of molybdenum is initiated at temperatures between about 800° C. and 1200° C. Above 1200° C., spontaneous grain growth occurs, drastically affecting the strength of the molybdenum article. This phenomenon proceeds at a rate which is dependent upon both temperature and time, being particularly aggravated by the extended periods of high temperature which are used in samarium production. As a result, an initially rigid molybdenum crucible becomes so weak and brittle upon cooling after one laboratory samarium production run that it can be crumbled by squeezing with the hand.

It has been discovered, however, that an economic advantage can be obtained through the use of molybdenum foil as an inner liner for a container made of some material which easily withstands the operating parameters encountered during samarium production. Since the molybdenum liner does not supply a large portion of the strength needed to contain a reaction mixture, but is primarily present for its resistance to corrosion, it can be made from very thin foils, e.g. those having a thickness of at least about 0.001 inches. The thin foils minimize liner expense, making it possible to simply discard the liner after each production run and still obtain a considerable cost advantage over the use of unlined tantalum containers which only withstand up to about 30 production runs.

From an economic standpoint, molybdenum is preferred as a liner material. The other resistant metals niobium, tantalum and tungsten will also perform satisfactorily in the practice of this invention, but suffer from the disadvantage of considerably higher cost and, particularly in the case of tungsten, a greater difficulty of working and fabrication than for molybdenum. It also should be noted that many alloys in which one, or any combination of the resistant metals (molybdenum, niobium, tantalum and tungsten) predominates can be used in the invention. Examples include alloys also containing zirconium, hafnium and the like; alloying metals which should be avoided contain those transition elements reacting readily with molten rare earth metals.

The samarium production process contemplated herein can be accomplished using any type of furnace which is capable of providing the required temperatures, and which can be evacuated to provide the necessary low pressures. As a matter of convenience, however, it is normally desirable to utilize the rapid heating capability and efficiency of an induction furnace.

Induction furnaces heat electrically conductive materials with an induced current, by means of an encompassing coil which is energized with alternating current having a frequency appropriate to the material which will be heated. The induced heat (watts) is a function of the square of induced current (amperes), multiplied by the resistance of the material (ohms); this relationship is given by the well-known power formula of Ohm's law: $P=I^2R$. In practice, although virtually any conductive substance can be heated, greater efficiency is obtained by inducing current into materials having higher resistances. Graphite is one of the preferred "susceptors" for receiving the induced current and is frequently used as a crucible for melting metals such as copper, which are not efficiently heated directly by induction. Some basic principles of induction heating, including data for selecting the material and size of a susceptor, are found in A. U. Seybolt and J. E. Burke, *Procedures in Experimental Metallurgy,* John Wiley and Sons, Inc., New York, 1953, at pages 11–14 and 19–20.

Graphite is not suitable for use alone as a combination susceptor/container for heating rare earth metals, due to its reaction to form stable rare earth carbides. If it is desired, then, to use graphite for efficiency reasons, an inner crucible of resistant material should also be used. The preferred configuration for practicing this invention includes a graphite susceptor of suitable thickness for the available power supply frequency, containing a crucible made of a refractory material (as previously described), which crucible is lined on its inner surface with a disposable metal foil. Most preferred, for reasons of economics, is a molybdenum foil liner.

Other embodiments are also useful, one of which is providing a metal foil liner directly to the graphite susceptor, without a refractory crucible. Also, to reduce the damage which would be caused by a leak or other failure of the liner, the susceptor can be coated on its inner surface with a layer of a carbide-forming resistant metal, such as tungsten, tantalum, titanium, niobium, molybdenum, and the like using chemical vapor deposition, plasma spraying, vacuum sputtering, or other metallizing techniques well known in the art. These embodiments suffer from the necessity for removing and handling the relatively fragile graphite susceptor, both before and after each samarium production run, greatly increasing the risk of damage. The readily apparent advantage obtained by using a separate crucible, therefore, is an ability to leave the susceptor installed inside the furnace, without disturbing it between runs.

A particular advantage resulting from the use of disposable foil liners is the opportunity to utilize crucibles for the reaction mixture which would not otherwise be acceptable in contact with molten rare earth metals. Of importance are the moderately inexpensive oxide crucible materials such as magnesia, alumina, silica, and similar refractories, which need only withstand the required temperatures to become useful. In addition, the more expensive materials such as various carbides and nitrides can be safely used, since liners will prevent attack by the rare earth metals. Considerable care must be exercised in the handling of these alternative materials, however, due to the relatively lesser durability as compared to metal crucibles.

Metals, as conductive materials, can also be used as susceptors in induction furnaces. The high temperature needed for samarium production restricts any list of viable candidates mainly to those which were previously noted as more resistant to attack by molten rare earths, i.e., the metals which can be used as crucibles inside graphite susceptors. A limiting factor is the expense of containers which are of sufficient thickness to be useful as efficient susceptors, since this is considerably greater than the thickness required for only mechanical strength. The expense is mitigated somewhat, however, because the use of metal foil liners will greatly extend the useful life of the containers.

The invention is further illustrated by the following examples, which are illustrative of various aspects of the invention, and are not intended as limiting the scope of the invention as defined by the appended claims.

EXAMPLE 1

A rectangular piece of resistant metal foil, approximately 6.5 inches high and 6 inches in length, is formed into a cylinder approximately $1\frac{7}{8}$ inches in diameter. Slits of about $\frac{1}{4}$ inch in depth are cut, approximately every $\frac{1}{4}$ inch around the end of the cylinder which will constitute its bottom. When a $1\frac{7}{8}$ inch diameter resistant metal foil disc is placed inside the cylinder at the bottom and the tabs formed between the slits in the cylinder are bent up beneath the disc, a foil liner measuring approximately $1\frac{7}{8}$ inches in diameter and $6\frac{1}{2}$ inches high is formed. To provide additional resistance against failure, a second $1\frac{7}{8}$ inch diameter foil disc is placed inside the formed liner, at the bottom.

The foil liner is placed inside of a niobium susceptor/crucible having a diameter of about 2 inches, a height of about 6.5 inches and a 6.06 inch thickness. Possible molten metal flow through small openings which remain in the foil liner can be prevented by placing a one-half to one inch layer of samarium oxide in the bottom of the liner. The liner is then filled with a mixture of samarium oxide (or mixed samarium-gadolinium oxide) and a stoichiometric equivalent of mischmetal, in sufficient quantity to fill the liner to a height of about 4 inches to about 4.5 inches.

The filled, lined crucible is placed inside the coils of a laboratory induction furnace, evacuated to a pressure of about 10 to about 50 microns of mercury, and heated to a temperature of about 1300° C. during a period of about 2 to about 3.5 hours. Samarium metal is collected on the inner surface of a generally conical-shaped tantalum condenser which is inverted over the crucible inside the evacuated area.

After cooling the furnace, the samarium metal product is removed from the condenser, while the foil liner is removed from the crucible and is discarded, after recovery of the contained rare earth compounds.

Following are the results which are obtained using molybdenum foil liners. The mischmetal is nominally 50 percent by weight cerium, 25 percent lanthanum, less than one percent by weight iron and magnesium, and the remainder comprises mixed rare earths. Samarium oxide has a nominal purity of at least 95 percent by weight, except that for Test 1 a mixed samarium-gadolinium oxide, which is approximately 50 percent by weight samarium oxide, is used.

| Test | Foil Thickness Inches | Weight of $Sm_2O_3$, Grams | Misch metal Wt., Grams | Samarium Recovery Grams | Samarium Recovery Percent |
|---|---|---|---|---|---|
| 1 | 0.002 | 250.3 | 106 | 79 | 73 |
| 2 | 0.005 | 212.8 | 183 | 170 | 93 |
| 3 | 0.005 | 243.0 | 209 | 193 | 92 |
| 4 | 0.005 | 243.0 | 209 | 176 | 84 |

Upon removal from the crucibles, the foil liners are found to be intact. Although a small amount of samarium vapor is able to pass through seam openings in the liners, it collects on the condenser surface and is recovered as product. Molten mischmetal sometimes flows through the seam openings in very small quantities, and can be absorbed by placing a layer of samarium oxide in the crucible, beneath the foil liner. In all cases, it is found that the foil is easily removed following a samarium preparation.

EXAMPLE 2

Tests similar to those of Example 1 are conducted, using metal foil liners inside graphite susceptor/crucibles. Results are equivalent, except that the samarium vapor leaks apparently cause a reaction with the interior surface of the graphite, forming areas of rare earth carbide. This, however, does not significantly affect the reusability of the graphite.

EXAMPLE 3

Using the procedure of Example 1, a 0.005 inch thick molybdenum foil liner measuring $12\frac{3}{4}$ inches diameter and 24 inches high, weighing about 0.9 kilograms, is constructed. This liner is charged with a 2.3 pound layer of mixed samarium-gadolinium oxide, for protection against leakage, and is placed inside of a tantalum crucible measuring $13\frac{1}{2}$ inches inside diameter and 24 inches high, also containing a protective layer of mixed samarium-gadolinium oxide weighing 2.8 pounds.

A mixture of 99.6 percent purity samarium oxide (100 pounds) and misch metal (93.4 pounds) is placed inside the liner, and the lined, filled crucible is positioned inside a graphite susceptor of an induction furnace. The furnace is evacuated and maintained at a total pressure of about 10 to 50 microns of mercury while heating to a temperature of about 1300° C. After about six hours, the